US009743716B2

(12) United States Patent
Almondo

(10) Patent No.: US 9,743,716 B2
(45) Date of Patent: Aug. 29, 2017

(54) SHOETREE WITH HIGH VERSATILITY OF USE

(71) Applicant: Mario Almondo, Parma (IT)

(72) Inventor: Mario Almondo, Parma (IT)

(73) Assignee: Mario Almondo, Parma (IT)

( * ) Notice: Subject to any disclaimer, the term of this patent is extended or adjusted under 35 U.S.C. 154(b) by 0 days.

(21) Appl. No.: 14/894,979

(22) PCT Filed: May 22, 2014

(86) PCT No.: PCT/EP2014/060509

§ 371 (c)(1),
(2) Date: Nov. 30, 2015

(87) PCT Pub. No.: WO2014/191293

PCT Pub. Date: Dec. 4, 2014

(65) Prior Publication Data

US 2016/0106184 A1 Apr. 21, 2016

(30) Foreign Application Priority Data

May 31, 2013 (IT) ..... MI2013A0890

(51) Int. Cl.
*A43D 3/14* (2006.01)
*A47G 25/82* (2006.01)

(52) U.S. Cl.
CPC ..... *A43D 3/1433* (2013.01); *A43D 3/1466* (2013.01); *A47G 25/82* (2013.01)

(58) Field of Classification Search
CPC ..... A43D 3/1466; A43D 3/14; A43D 3/1416; A43D 3/1425; A43D 3/1433
USPC ..... 12/114.2; 223/118
See application file for complete search history.

(56) References Cited

U.S. PATENT DOCUMENTS

D245,204 S * 7/1977 Walter ..... D2/979
4,718,135 A * 1/1988 Colvin ..... A43D 3/1466 12/114.2
5,884,823 A * 3/1999 Carroll ..... A47G 25/82 223/118
7,337,933 B1 * 3/2008 Klinberg ..... A47G 25/82 223/118
D640,039 S * 6/2011 Szymanski ..... D2/642
D658,351 S * 5/2012 Szymanski ..... D2/642
9,386,875 B2 * 7/2016 Clifton ..... A47G 25/82
9,498,077 B2 * 11/2016 Carlson ..... A47G 25/905
(Continued)

FOREIGN PATENT DOCUMENTS

DE 809146 C 7/1951
GB 573996 A 12/1945

OTHER PUBLICATIONS

International Search Report issued Jul. 21, 2014 re: Application No. PCT/EP2014/060509; citing: GB 573 996 A, U.S. Pat. No. 4,718,135 A and DE 809 146 C; pp. 3.
(Continued)

*Primary Examiner* — Marie Bays
(74) *Attorney, Agent, or Firm* — Cantor Colburn LLP

(57) ABSTRACT

A shoetree includes a tubular element adapted to be inserted in a shoe and to bear at one end a portion that substantially reproduces the shape of the toe of a shoe. The opposite end includes with a shoehorn-shaped portion, which is pivoted to the tubular element, in order to pass from a condition for use as a shoetree to a condition for use as a shoehorn.

3 Claims, 10 Drawing Sheets

(56) References Cited

U.S. PATENT DOCUMENTS

| | | | | |
|---|---|---|---|---|
| 2007/0187441 | A1* | 8/2007 | Klinberg | A47G 25/82<br>223/118 |
| 2008/0307595 | A1* | 12/2008 | Zielinski | A47K 7/028<br>15/144.4 |
| 2015/0083761 | A1* | 3/2015 | Clifton | A47G 25/82<br>223/118 |
| 2015/0313396 | A1* | 11/2015 | Carlson | A47G 25/905<br>2/239 |

OTHER PUBLICATIONS

Written Opinion issued Jul. 21, 2014 re: Application No. PCT/EP2014/060509; citing: GB 573 996 A, U.S. Pat. No. 4,718,135 A and DE 809 146 C.

* cited by examiner

SHOETREE WITH HIGH VERSATILITY OF USE

TECHNICAL FIELD

The present disclosure relates to a shoetree with high versatility of use. More specifically, the disclosure relates to a shoetree with a twofold function.

BACKGROUND

Conventional shoetrees are available to maintain the shape of the shoes into which they are inserted. Conventional shoetrees are usually include a front portion that reproduces the shape of the toe of the shoe and a rear portion, connected to the front portion, which is adapted to engage, by digging in, against the heel of the shoe.

In this manner, the shoetree is under tension inside the shoe and this contributes to maintaining the shoe in shape.

In order to put on some types of shoes, it is mandatory for users to resort to a shoehorn.

Conventional shoehorns are constituted by a sort of blade that is contoured so as to be interposed between the heel of the foot of the user and the heel of the shoe, so as to facilitate the entry of the foot into the shoe and thus the donning of the shoe.

Often, when the shoehorn would be useful, it is not within reach of the user.

The aim of the present disclosure is to provide a shoetree with high versatility of use.

SUMMARY

Within this aim, the disclosure provides a shoetree that has a twofold function.

The disclosure provides a shoetree that substantially maintains the space occupation of conventional shoetrees.

The disclosure further provides a shoetree that is highly reliable, easily and practically implemented and low cost.

The disclosure provides a shoetree comprising a tubular element adapted to be inserted in a shoe and to bear at one end a portion that substantially reproduces the shape of the toe of a shoe, said tubular element being provided, at the opposite end, with a shoehorn-shaped portion, which is pivoted to said tubular element, in order to pass from a condition for use as a shoetree to a condition for use as a shoehorn.

BRIEF DESCRIPTION OF THE DRAWINGS

Further characteristics and advantages of the disclosure will become better apparent from the description of preferred, but not exclusive, embodiments of the shoetree according to the disclosure, which are illustrated by way of non-limiting example in the accompanying drawings. In the drawings.

DETAILED DESCRIPTION OF THE DRAWINGS

Figures 1, 2:
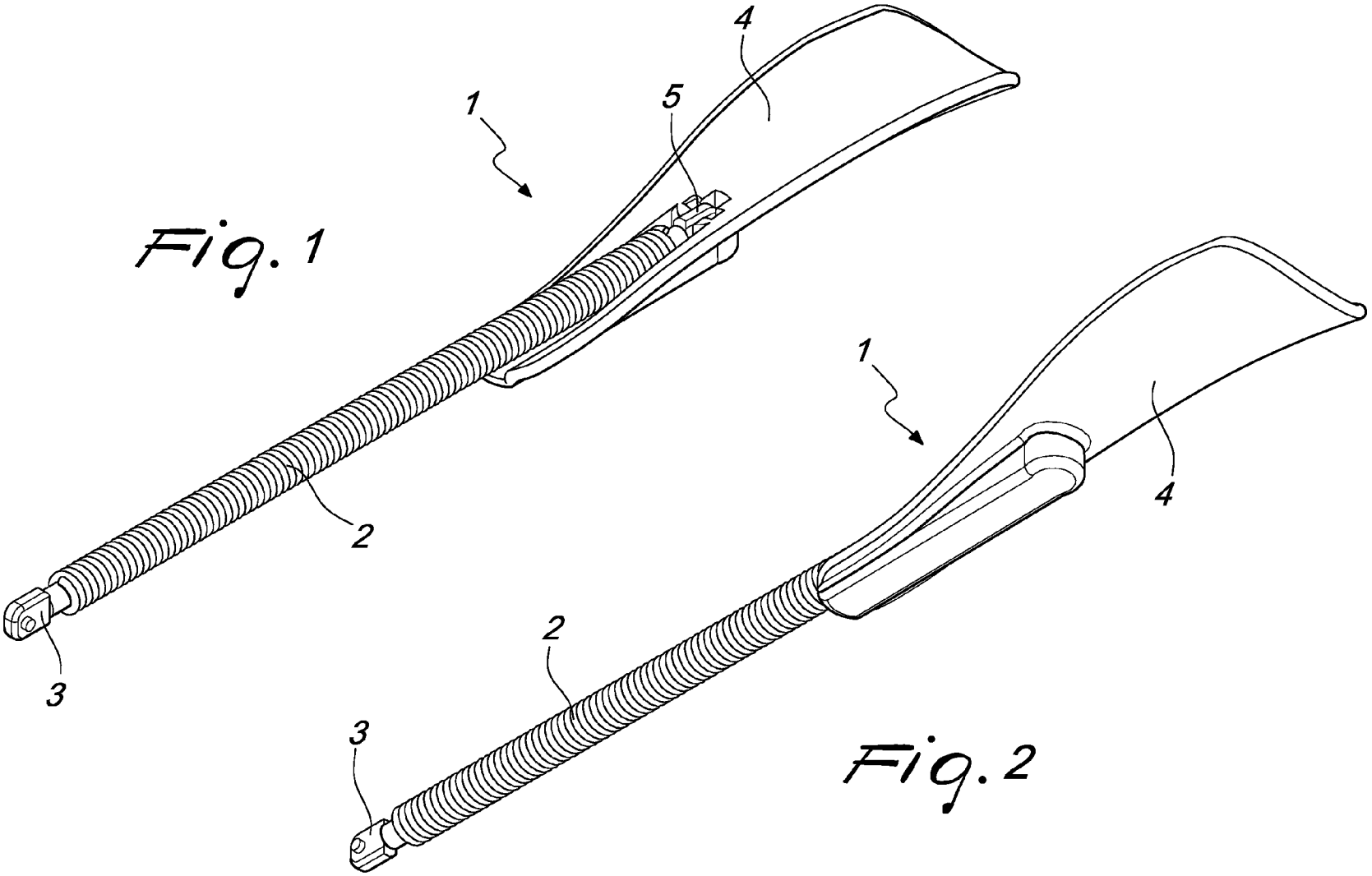
FIG. 1 is a perspective view of a first embodiment of the shoetree according to the present disclosure.
FIG. 2 is a further perspective view of the shoetree of FIG. 1.

With reference to the figures, the shoetree according to the disclosure, generally designated by the reference numeral 1, in the first embodiment, comprises a substantially tubular elastic body 2, which is provided at one end with a portion 3 that is adapted for example to be engaged by a shape that reproduces the toe of a shoe, not shown.

The opposite end of the elastic tubular element 2 is coupled by way of hinged means 5 to a portion 4 shaped like a shoehorn. Conveniently, the portion 4 is arranged so as to be positioned substantially along the same axis of the elastic tubular element 2 when the shoetree 1 is to be used in the shoehorn configuration.

In such case, in fact, the shoehorn-shaped portion 4 and the tubular element 2 are substantially aligned as shown in FIGS. 1, 2.

Figure 3:
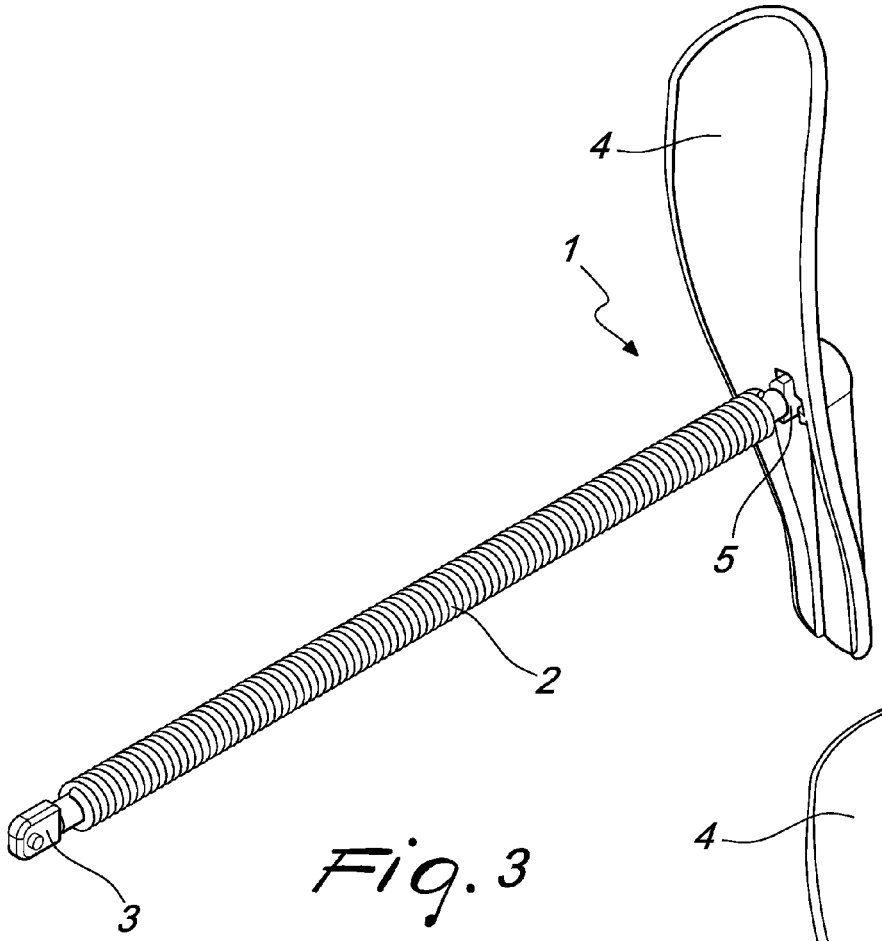
FIG. 3 is a perspective view of the shoetree according to a first embodiment, in an active configuration for use as a shoetree.
Figure 4:
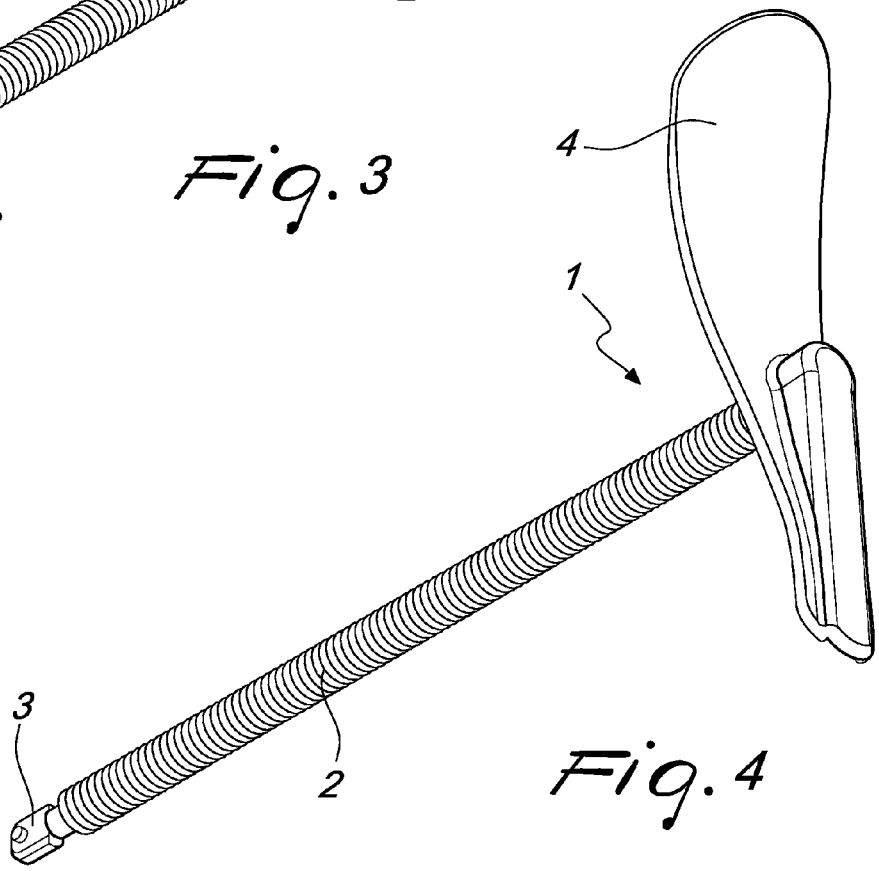
FIG. 4 is a further perspective view of the shoetree of FIGS. 1, 2 and 3.
Figure 5:
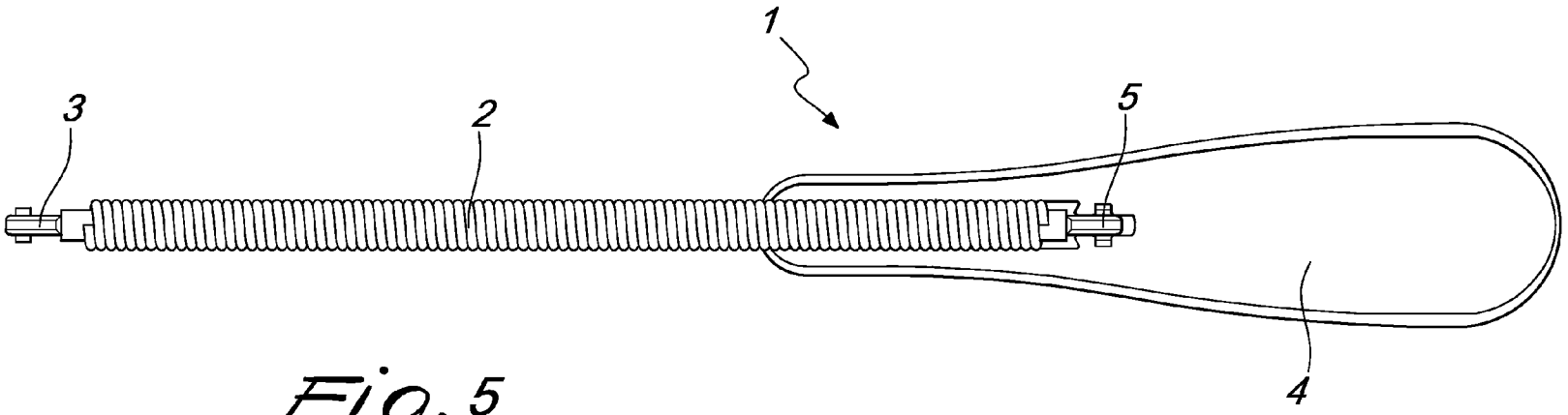
FIG. 5 is a plan view of the shoetree according to a first embodiment in a second active configuration.
Figure 6:
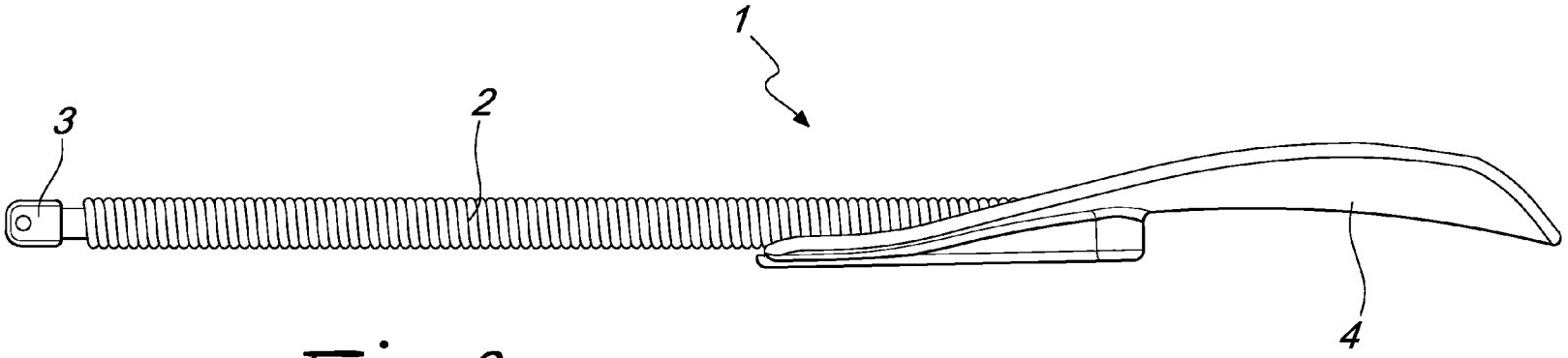
FIG. 6 is a side view of the shoetree according to the first embodiment in a second active configuration.
Figure 7:
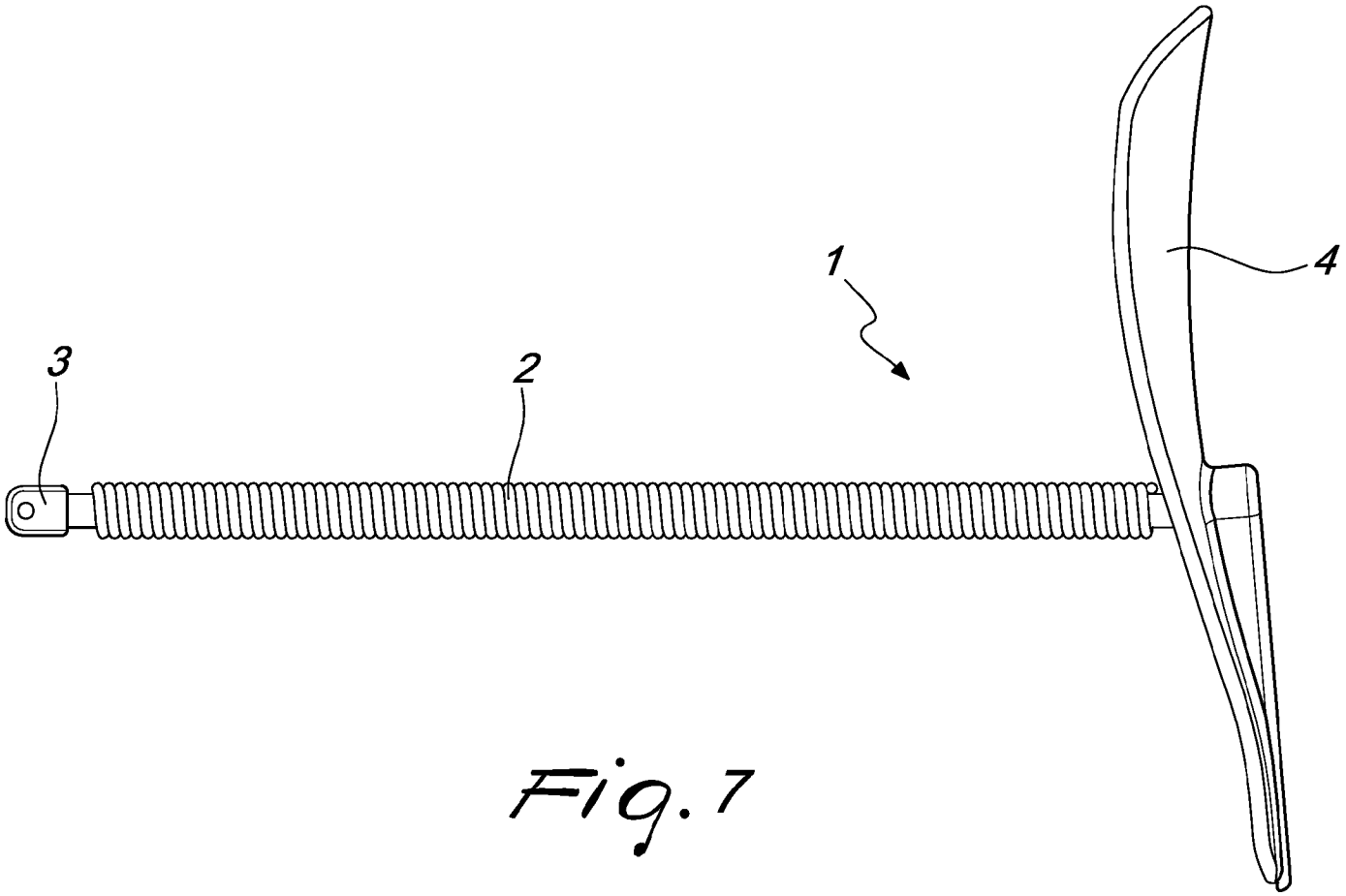
FIG. 7 is a side view of the shoetree according to the disclosure in the active configuration in the shoetree mode.
Figures 8, 9:
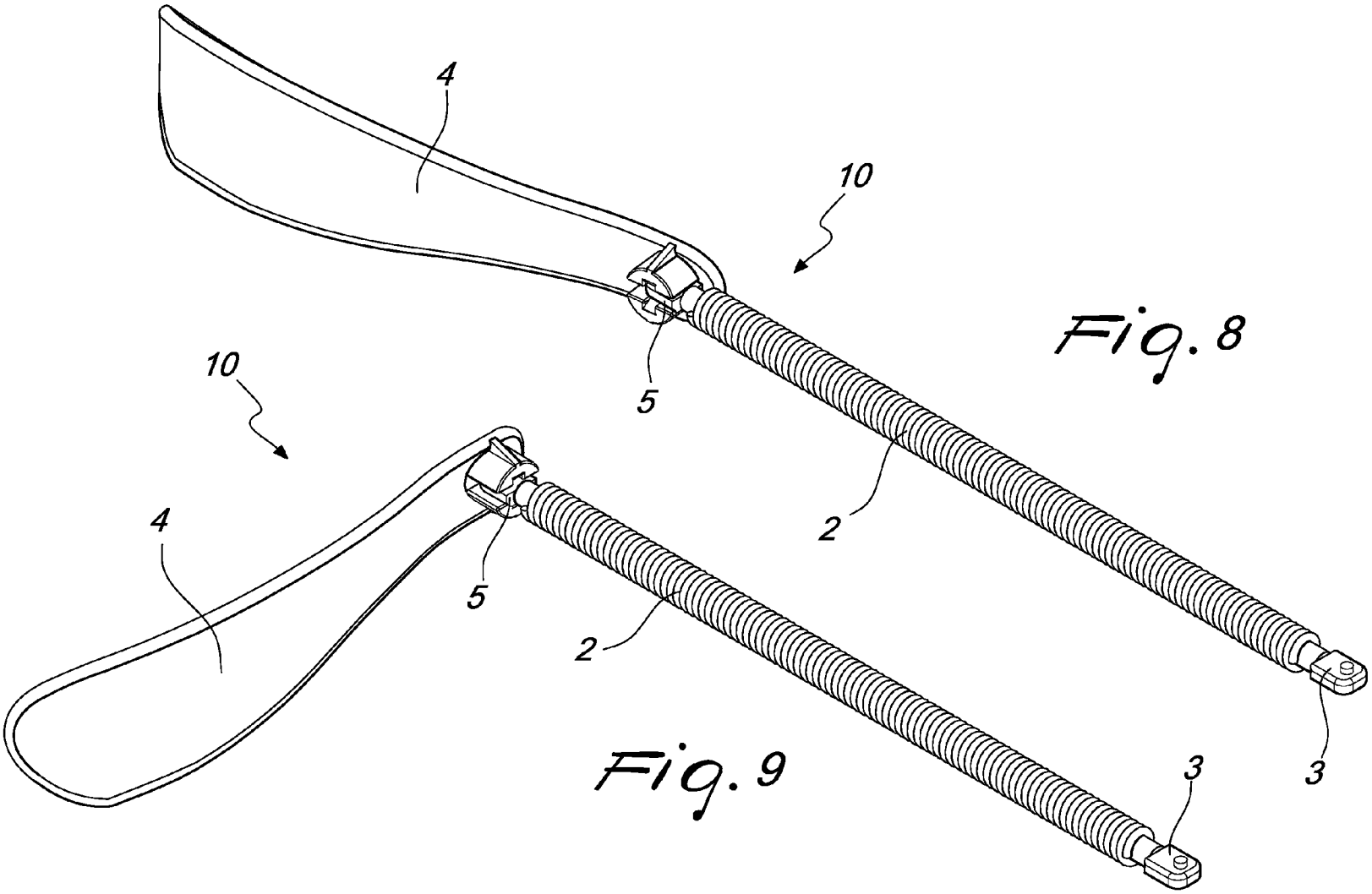
FIG. 8 is a perspective view of a second embodiment of the shoetree according to the disclosure.
FIG. 9 is a perspective view of the shoetree according to the second embodiment, in a second active condition.
Figures 10, 11:
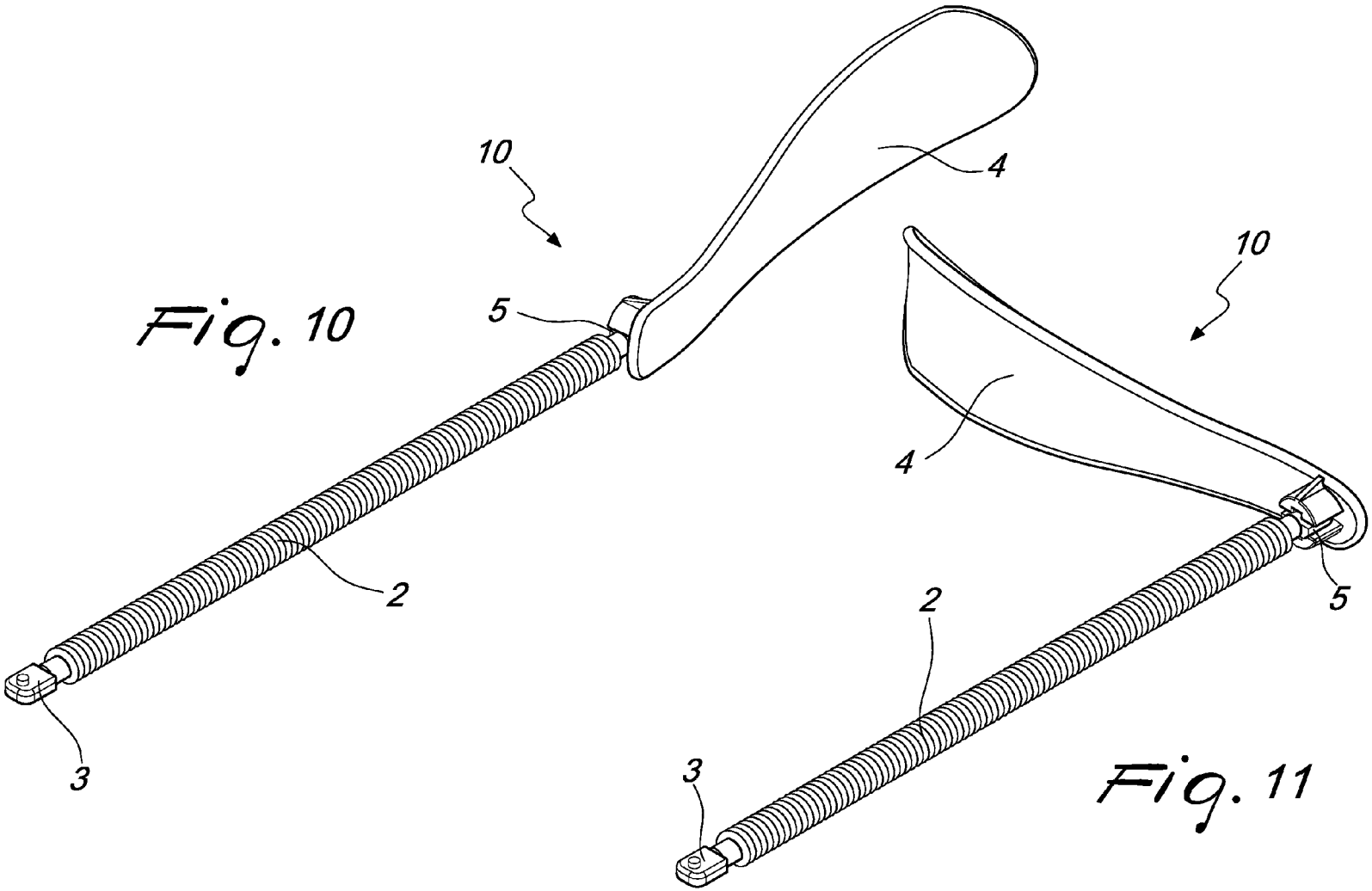
FIG. 10 is a perspective view of the shoetree of the second embodiment.
FIG. 11 is a perspective view of the shoetree according to the second embodiment.

In the active configuration as a shoetree, illustrated in FIGS. 3 and 4, and also 7, the shoehorn-shaped portion 4 is arranged so as to be substantially perpendicular to the elastic tubular element 2, so as to allow the user to insert the shoehorn-shaped portion 4 in contact with the heel of the shoe, in the position opposite the front end 3 of the elastic tubular element.

The pivoting between the tubular element 2 and the shoehorn-shaped portion 4 occurs at the substantially central region of the shoehorn 4.

By contrast, in the second embodiment of the disclosure, illustrated in FIGS. 8, 9, 10 and 11, the shoehorn according to the disclosure, generally designated by the reference numeral 10, comprises, similarly to the first embodiment, a shoehorn-shaped portion 4 that is connected by way of a hinge 5 to a tubular element 2, but in which the hingeing occurs at one end of the shoehorn-shaped portion 4.

It should be noted that, in the figures, the same reference numerals are used to designate the same elements. Therefore, in the different embodiments, these reference numerals are used to indicate elements that are common to the different embodiments.

FIGS. 12-15 show a third embodiment of the shoetree according to the disclosure, generally designated by the reference numeral 100, in which the portion of tubular element 2 is coupled to the shoehorn-shaped portion 4 by way of a flat portion 6, which is integral with the shoehorn-shaped portion 4, by way of the hingeing 3 as in the previous embodiments.

Figure 13:
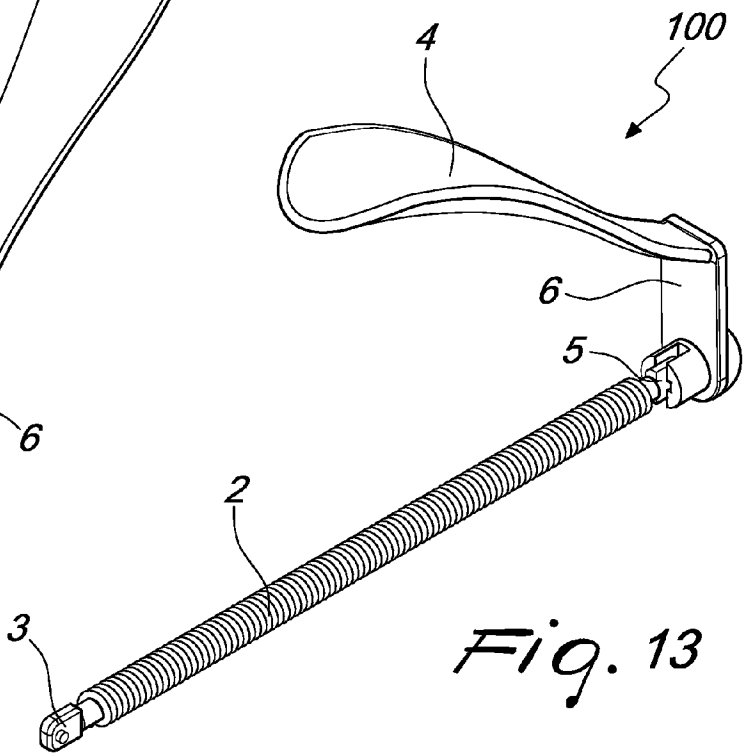
FIG. 13 is a perspective view of the third embodiment of the shoetree according to the present disclosure, in a third active condition that is different from that shown in FIG. 12.
Figure 12:
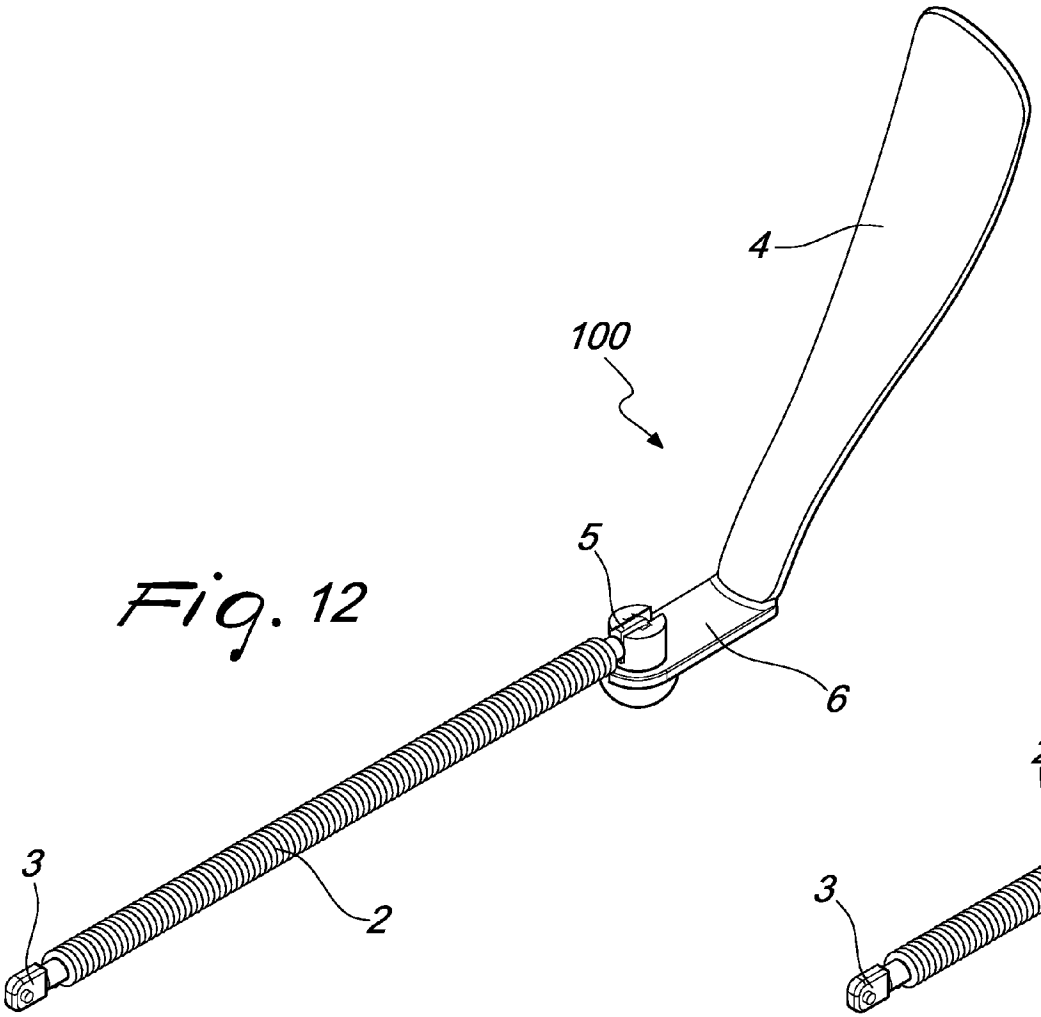
FIG. 12 is a perspective view of a third embodiment of the shoetree according to the present disclosure.
Figures 14, 15:
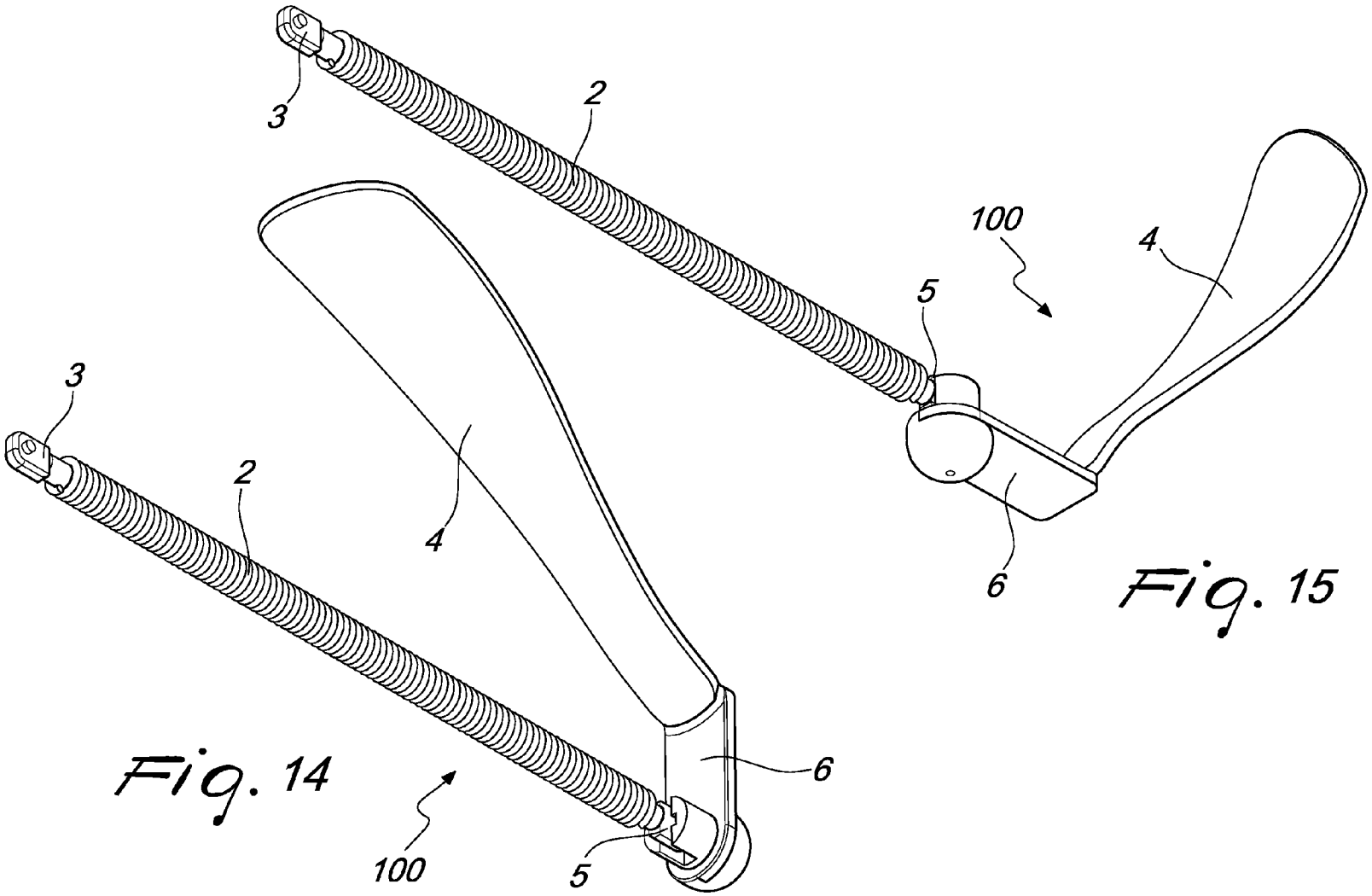
FIG. 14 is a perspective view of the shoetree according to the disclosure shown in FIG. 13.
FIG. 15 is a perspective view of the shoetree according to the disclosure in the same active condition shown in FIG. 12.
Figure 16:
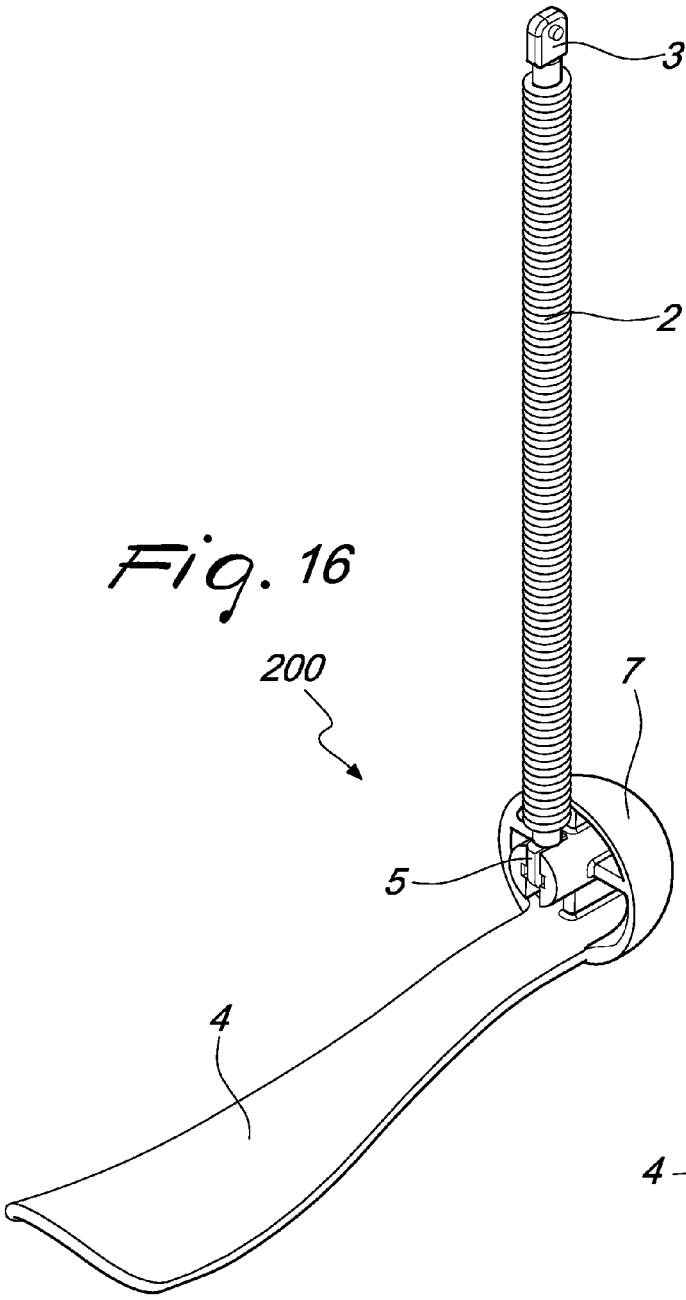
FIG. 16 is a perspective view of a fourth embodiment of the shoetree, in an active condition for use not as a shoetree.
Figure 17:
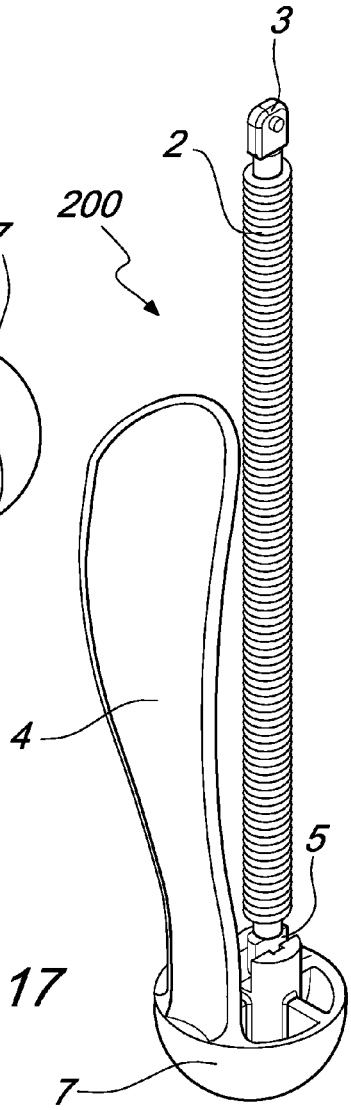
FIG. 17 is a view of the shoetree in FIG. 16 in the active configuration for use as a shoetree.
Figure 18:
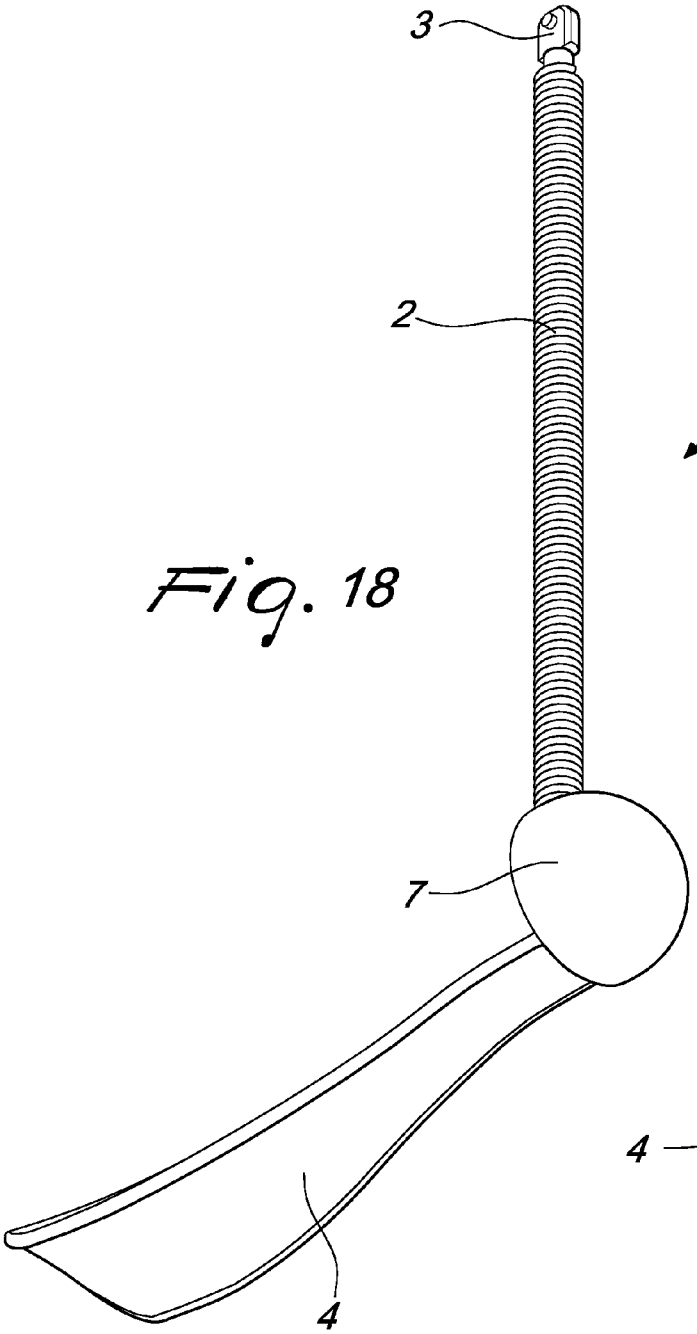
FIG. 18 is a further perspective view, from below, of the shoetree according to the disclosure, in the active condition shown in FIG. 16.
Figure 19:
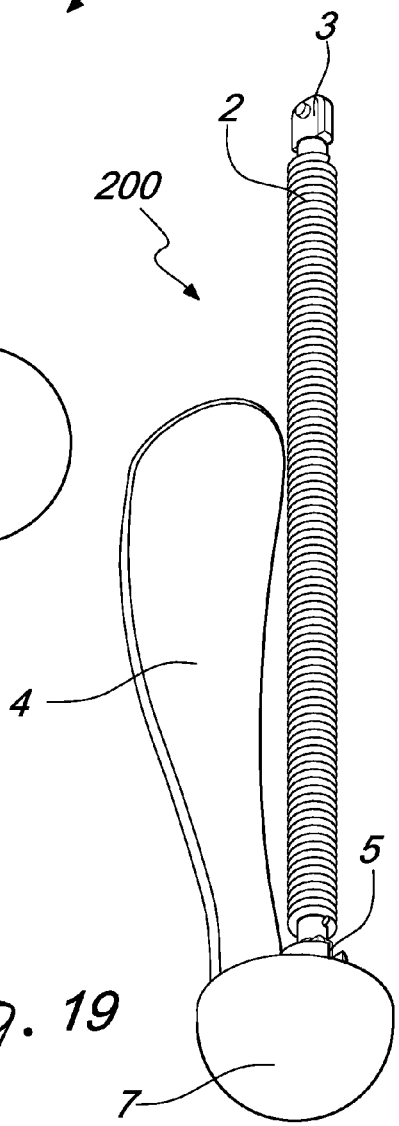
FIG. 19 is a further perspective view of the shoetree according to the fourth embodiment.

In this case, in the condition for use as a shoetree, illustrated in FIGS. 13 and 14, the portion of shoetree 4 arranges itself in a position substantially parallel to the tubular element 2.

In the fourth embodiment, illustrated in FIGS. 16-19, and designated by the reference numeral 200, the shoetree according to the disclosure again has a tubular portion 2 that is connected by way of hingeing 5 to a shoehorn-shaped portion 4. In this case, the hingeing portion is defined in a hemispherical element 7 that is integral with the shoehorn-shaped portion 4 and is oriented according to an axis that is substantially perpendicular to the axis of the shoehorn-shaped portion 4. In this manner, in the condition for use as a shoehorn, shown in FIG. 1, the tubular element 2 will arrange itself substantially perpendicular to the shoehorn-shaped portion 4, while, in the condition for use as a shoetree, the shoehorn-shaped portion 4 will arrange itself in a position substantially parallel to the tubular element 2.

It should be noted that if the elastic tubular element 2 is arranged in the condition of maximum extension, accommodated inside the hemispherical element 7, the shoetree can be used as a shoehorn without requiring the user to bend.

In this condition the elastic tubular element 2 is locked in the hemispherical element 7 which, thanks to its geometric shape structure and to the elasticity of the plastic material with which the hemispherical element is made, is capable of widening upon the transition of the elastic tubular element and then narrowing again after the transition of the elastic tubular element, in this way acting as a lock for the shoehorn-shaped element 4 (which is integrally connected to the hemispherical element) in the extended position. In this shape structure the elastic tubular element, integrally connected with the front portion, substantially reproducing the shape of the toe of a shoe, acts as a handle for the shoehorn-shaped portion 4 in the extended position.

In practice it has been found that the shoetree according to the present disclosure fully achieves the set aim and objects, in that it makes it possible to be used both as a shoetree and, in conjunction, as a shoehorn.

The shoetree, thus conceived, is susceptible of numerous modifications and variations, all of which are within the scope of the appended claims. Moreover, all the details may be substituted by other, technically equivalent elements.

In practice the materials employed, and the contingent dimensions and shapes, may be any according to requirements and to the state of the art.

The disclosures in Italian Patent Application No. MI2013A000890 from which this application claims priority are incorporated herein by reference.

The invention claimed is:

1. A shoetree, comprising a tubular element adapted to be inserted in a shoe and to bear at a first end a portion that substantially reproduces a shape of a component of a shoe, wherein said tubular element includes, at a second opposite end, a portion pivoted to said tubular element, in order to pass from a first condition for use as a shoetree to a second condition for use as a shoehorn, wherein said portion is pivoted to said tubular element substantially at one end of said portion, said portion is provided, at a region for pivoting to said tubular element, with a flat extension portion that accommodates a hinge for pivoting said tubular element, and wherein said portion is provided at one end, opposite to a second opposite end adapted to be used as a shoehorn, with a hemispherical element adapted to accommodate said hinge for the pivoting of said tubular element.

2. The shoetree according to claim 1, wherein said portion is pivoted to said tubular element substantially at a central region of said portion.

3. The shoetree according to claim 1, wherein said tubular element is elastic so that it can be tensioned inside said shoe.

* * * * *